US007736232B2

(12) United States Patent
Linard et al.

(10) Patent No.: US 7,736,232 B2
(45) Date of Patent: Jun. 15, 2010

(54) METHODS AND SYSTEMS FOR IMPLEMENTING A SECONDARY GAME ACROSS A PLURALITY OF GAMING MACHINES

(75) Inventors: Sylvie Linard, London (GB); John Papanastasiou, Croydon (GB); Thierry Brunet de Courssou, Henderson, NV (US)

(73) Assignee: Mudalla Technology, Inc., Palo Alto, CA (US)

( * ) Notice: Subject to any disclaimer, the term of this patent is extended or adjusted under 35 U.S.C. 154(b) by 699 days.

(21) Appl. No.: 11/354,568

(22) Filed: Feb. 14, 2006

(65) Prior Publication Data

US 2006/0205492 A1 Sep. 14, 2006

Related U.S. Application Data

(60) Provisional application No. 60/661,844, filed on Mar. 14, 2005.

(51) Int. Cl.
*A63F 9/24* (2006.01)

(52) U.S. Cl. ..... 463/42; 463/20

(58) Field of Classification Search ..... 463/16, 463/17, 20, 26, 40–42
See application file for complete search history.

(56) References Cited

U.S. PATENT DOCUMENTS

| | | | |
|---|---|---|---|
| 4,593,904 | A | 6/1986 | Graves |
| 4,695,053 | A | 9/1987 | Vazquez, Jr. et al. |
| 5,280,909 | A | 1/1994 | Tracy |
| 5,342,049 | A | 8/1994 | Wichinsky et al. |

(Continued)

FOREIGN PATENT DOCUMENTS

| | | |
|---|---|---|
| EP | 1298608 A2 | 4/2003 |

(Continued)

OTHER PUBLICATIONS

International Preliminary Report on Patentability dated May 24, 2008, in related International Application No. PCT/US06/05305, filed Feb. 14, 1006.

(Continued)

*Primary Examiner*—John M Hotaling
*Assistant Examiner*—Eric M Thomas
(74) *Attorney, Agent, or Firm*—Young Law Firm, P.C.

(57) ABSTRACT

A method of operating a plurality of networked gaming machines in which each of the plurality of networked gaming machines is configured to enable a same or a different primary game to be played, may include steps of (randomly, for example) selecting a gaming machine of the plurality of gaming machines; activating a secondary game on the selected gaming machine for a limited period of time and generating a player-perceptible indication that the secondary game is active on the selected gaming machine. When the limited period of time has elapsed, a step of de-activating the secondary game on the selected gaming machine may be carried out, whereupon the method may revert to the selecting step. The secondary game appears to the players on the casino floor as a roving and unpredictable opportunity to win additional prizes or bonus, or to be able to enter large outcome games, with animations, sounds and/or other enticing effects running from one gaming machine to another. Players may attempt to "follow" the secondary game as it "moves" or "jumps" from one gaming machine to another, thereby further animating the casino floor.

51 Claims, 5 Drawing Sheets

U.S. PATENT DOCUMENTS

| | | | | |
|---|---|---|---|---|
| 5,823,873 | A | 10/1998 | Moody | |
| 6,012,983 | A | 1/2000 | Walker et al. | |
| 6,019,374 | A | 2/2000 | Breeding | |
| 6,050,895 | A | 4/2000 | Luciano, Jr. et al. | |
| 6,077,163 | A | 6/2000 | Walker et al. | |
| 6,146,273 | A | 11/2000 | Olsen | |
| 6,244,957 | B1 | 6/2001 | Walker et al. | |
| 6,267,669 | B1 | 7/2001 | Luciano, Jr. et al. | |
| 6,283,474 | B1 | 9/2001 | de Keller | |
| 6,409,597 | B1 | 6/2002 | Mizumoto | |
| 6,517,433 | B2 | 2/2003 | Loose et al. | |
| 6,522,312 | B2 | 2/2003 | Ohshima et al. | |
| 6,761,632 | B2 | 7/2004 | Bansemer et al. | |
| 6,811,482 | B2 | 11/2004 | Letovsky | |
| 7,008,324 | B1 * | 3/2006 | Johnson et al. | 463/42 |
| 2002/0107072 | A1 * | 8/2002 | Giobbi | 463/42 |
| 2002/0147040 | A1 | 10/2002 | Walker et al. | |
| 2003/0114218 | A1 | 6/2003 | McClintic | |
| 2003/0211881 | A1 | 11/2003 | Walker et al. | |
| 2004/0072617 | A1 | 4/2004 | Takahashi et al. | |
| 2004/0102238 | A1 | 5/2004 | Taylor | |
| 2004/0180722 | A1 * | 9/2004 | Giobbi | 463/42 |
| 2004/0219969 | A1 * | 11/2004 | Casey et al. | 463/20 |
| 2005/0096114 | A1 * | 5/2005 | Cannon et al. | 463/16 |
| 2006/0040733 | A1 * | 2/2006 | Baerlocher et al. | 463/26 |
| 2006/0040734 | A1 * | 2/2006 | Baerlocher et al. | 463/26 |
| 2006/0116187 | A1 * | 6/2006 | Johnson et al. | 463/16 |

FOREIGN PATENT DOCUMENTS

| | | | |
|---|---|---|---|
| EP | 1298608 | A3 | 10/2004 |
| WO | WO 01/41892 | A2 | 6/2001 |
| WO | 02096528 | A2 | 5/2002 |
| WO | 03045520 | A1 | 6/2003 |

OTHER PUBLICATIONS

International Search Report mailed Aug. 13, 2007, in related International Application No. PCT/US06/005305, filed Feb. 14, 2006.

Written Opinion of the International Searching Authority mailed Aug. 13, 2007, in related International Application No. PCT/US06/005305, filed Feb. 14, 2006.

Extended (Supplementary) Search Report from European Patent Office of Apr. 24, 2009 (10 pages).

* cited by examiner

502

| Number | Odds | Odds | Payoff for $1 stake | Chance to win |
|---|---|---|---|---|
| 1 | 6/4 | 1.5 | 2.5 | 28.0% |
| 2 | 4/1 | 4 | 5 | 14.0% |
| 3 | 5/2 | 2.5 | 3.5 | 20.0% |
| 4 | 9/2 | 4.5 | 5.5 | 12.7% |
| 5 | 16/1 | 16 | 17 | 4.1% |
| 6 | 6/1 | 6 | 7 | 10.0% |
| 7 | 8/1 | 8 | 9 | 7.8% |
| 8 | 12/1 | 12 | 13 | 5.4% |

FIG. 5

METHODS AND SYSTEMS FOR IMPLEMENTING A SECONDARY GAME ACROSS A PLURALITY OF GAMING MACHINES

CROSS REFERENCE TO RELATED APPLICATIONS

This application claims the benefit under 35 U.S.C. §119 (e) of provisional application Ser. No. 60/661,844, filed Mar. 14, 2005, which application is hereby incorporated herein in its entirety.

COPYRIGHT NOTICE PERMISSION

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright 2006 Cyberscan Technology Inc., All Rights Reserved.

BACKGROUND OF THE INVENTION

1. Field of the Invention

This invention relates generally to the field of gaming. More particularly, embodiments of the present invention relate to networked gaming machines within or across casinos or other gaming establishments.

2. Description of the Related Art

Electronic gaming machines available in casinos and other legal places are games of chance whereby the player repetitively tries his or her luck to win prizes. The player purchases an amount of credit to play by transferring monetary value into the gaming machine or into the networked gaming system using coins, banknotes, vouchers or any other financial instrument or form of electronic money. In exchange therefor, the player may be given an electronic credit on a local gaming machine or alternatively on a networked gaming system by way of a player account managed on a server. Each time the player plays a game, his or her credit balance is debited by the amount of the wager. Depending on the local game regulation, the wager amount is either hardwired into the gaming machine or selectable by the user prior to playing a game. The play-and-debit scenario is typically repeated until the player's credit is used up or until a prize is won. The prize value is derived from randomly drawn numbers, an outcome prize matrix and the wager amount.

Each player typically has his or her own favorite gaming machines or games and tends to favor those over the other gaming machines on the casino floor. To maximize gaming revenue, it is believed to be desirable to encourage players to move about the casino floor and to discover and try their luck at different gaming machines. What are needed are methods and systems that would provide some incentive for the player to try new gaming machines. Such methods and systems should preferably create some "buzz" and excitement on the casino floor.

SUMMARY OF THE INVENTION

Accordingly, according to an embodiment thereof, the present invention may be a method of operating a plurality of networked gaming machines, each of the plurality of networked gaming machines being configured to enable a same or a different primary game to be played. The method may include steps of selecting at least one gaming machine of the plurality of gaming machines; generating a player perceptible indication that at least one secondary game has or will be activated on the selected at least one gaming machine, and activating at least one secondary game on the selected gaming machine(s) for a limited period of time; when the limited period of time has elapsed, de-activating the secondary game (s) on the selected gaming machine(s), and returning to the selecting step.

According to further embodiments, game play of the primary game is not interrupted on the selected gaming machine while the secondary game may be activated. Game play of the primary game may not be interrupted while the player perceptible indication is generated indicating that the at least one secondary game has or will be activated. A secondary game may be activated on an unattended gaming machine. The secondary game may be configured to operate free of player interactivity. The secondary game and/or player perceptible indication may be configured to operate free of player interactivity and the method may further include showing an animation prior to awarding a predetermined bonus value or a randomly drawn prize. The secondary game and/or player perceptible indication may be activated when a player is carded-in. The secondary game and/or player perceptible indication may be activated on a gaming machine when a player is not playing but has some credits. The limited time period may be a predetermined period of time controlled by a counter. The counter may reside on the selected gaming machine. The plurality of networked gaming machines may be coupled to a central server, and the counter may reside on the central server. The plurality of networked gaming machines may be coupled to a central server, and the activating and/or de-activating steps may be controlled or triggered by the central server. The activating and/or de-activating steps may be controlled or triggered by the selected gaming machine. At least one of the plurality of networked gaming machines may include a first and a second display, and the primary game may be displayed on the first display and the secondary game may be displayed on the second display of the selected gaming machine. At least one of the plurality of networked gaming machines may include a single display, and the primary game and/or player perceptible indication may be displayed on the single display and the secondary game may be displayed on at least a portion of the single display without interrupting game play of the primary game. The secondary game and/or player perceptible indication may be displayed as a pop-up window, a picture-in-picture or a picture-by-picture (for example) within the single display of the selected gaming machine. The player perceptible indication may include a light, an animation, a video, a vibration and/or a sound, for example, immediately before or during activation of the secondary game. A succession of the activating and deactivating steps may create an impression that the secondary game(s) and/or player perceptible indication(s) are roving among a pre-selected subset of gaming machines or for across an entire casino floor. The selecting step may randomly select one or more gaming machines from the plurality of networked gaming machines. The selecting step may select more than one of the plurality of gaming machines, and the activating and de-activating steps may be carried out for each of the selected ones of the plurality of gaming machines.

The activating, generating and/or the deactivating steps may be controlled or triggered in a serverless fashion by at least one predetermined or randomly selected gaming machine. The activating, generating and/or deactivating steps may be controlled or triggered in a peer-to-peer fashion by at least one predetermined or randomly selected gaming machine. The activating or generating step may activate a same secondary game on each of the selected gaming machines. The activating or generating step may activate a different secondary game on at least two of the selected gaming machines. The method may further include steps of playing an animation before the activating and/or de-activating steps. The outcome of the secondary game may depend upon the outcome of the primary game or the outcome of the secondary game may be independent of the outcome of the primary game. The selecting step may be configured to select the gaming machine(s) only if the gaming machine(s) is currently being played. The method may further include a step of selecting a paytable from a plurality of paytables, the selected paytable determining a payout of the secondary game. The paytable selecting step may randomly select the paytable from the plurality of paytables. One or more tertiary games may be provided, and the method further may include steps of selectably activating the tertiary game(s) on the selected gaming machine(s). Activation of the tertiary game may be dependent upon the outcome of the primary and/or secondary games activated on the selected gaming machine(s). The counter may be visible to the player of the selected gaming machine(s). Alternatively, the counter may be not visible to the player of the selected gaming machine(s). The activated secondary game(s) on the selected gaming machine(s) may be configured to become increasingly transparent or gradually fade (for example) over the limited period of time.

According to another embodiment thereof, the present invention is a gaming system that may include a communication network; a plurality of gaming machines coupled to the communication network, each of the plurality of gaming machines being configured to enable a same or different primary game to be played, a secondary game that may be selectively activated on at least one selected gaming machine for a limited period of time, and a player perceptible indication that at least one secondary game has or will be activated on the selected at least one gaming machine without interrupting game play of the primary game.

The secondary game may be configured to be de-activated at the end of the limited period of time. The gaming system may also include a counter that controls a length of the limited period of time. The counter may be visible to a player of the selected gaming machine(s). Alternatively, the counter may be not visible to a player of the selected gaming machine(s). The activated secondary game(s) on the selected gaming machine(s) may be configured to become increasingly transparent (or gradually fade, for example) over the limited period of time. Each of the plurality of gaming machines may be configured to select a next gaming machine on which the secondary game is to be activated. Each of the plurality of gaming machines may be configured to select a next gaming machine on which the secondary game is to be activated. The gaming system may include a central server coupled to the communication network and the central server may be configured to select the next gaming machine on which the player-perceptible indication is to be activated and the secondary game is to be activated. The central server may be configured to select the next gaming machine on which the player-perceptible indication is to be activated and the secondary game is to be activated. The system may be configured such that a selection of the next gaming machine on which the player-perceptible indication is to be activated and the secondary game is to be activated may be performed in a serverless fashion. The system may be configured such that the selection of the next gaming machine on which the player-perceptible indication is to be activated and the secondary game is to be activated may be performed in a peer-to-peer fashion. The gaming system may further include a serverless scheme configured to select the next gaming machine on which the player-perceptible indication is to be activated and the secondary game is to be activated. The gaming system may further include a peer-to-peer scheme configured to select the next gaming machine on which the player-perceptible indication is to be activated and the secondary game is to be activated. The counter may reside on the selected gaming machine. A central server may be coupled to the communication network and the counter may reside on the central server. One or more of the plurality of networked gaming machines may include a first and a second display, and the gaming machine(s) may be configured to display the primary game on at least the first display and may be configured to display the player-perceptible indication is to be activated and the secondary game on the second display. One or more of the plurality of networked gaming machines may include a single display, and the gaming machine(s) may be configured to display the primary game on the single display and may be configured to display the player-perceptible indication is to be activated and the secondary game on at least a portion of the single display. The gaming machine(s) may be configured to display the player-perceptible indication is to be activated and the secondary game as one of a pop-up window, a picture-in-picture or a picture-by-picture (for example) within the single display. At least some of the plurality of gaming machines may be further configured to generate a player perceptible indication that the secondary game has or will be activated. At least some of the gaming machines may include means for generating a light, an animation, a video, a vibration and/or a sound (for example) immediately before or during activation of the secondary game. The secondary game may be activated on at least two of the plurality of gaming machines. The same secondary game may be activated on each of the selected gaming machines or a different secondary game may be activated on each of the selected gaming machines. The selected gaming machines may be further configured to play an animation before the secondary game is activated and/or de-activated. The outcome of the secondary game may depend upon the outcome of the primary game, or the outcome of the secondary game may be independent of an outcome of the primary game. The secondary game may be configured to be activated on a selected gaming machine only if the selected gaming machine is currently being played. The secondary game may be configured to selectively pay winnings according to a selected one of a plurality of paytables. The system may further comprise at least one tertiary game configured to be selectively activated on the selected gaming machine(s). Activation of the tertiary game(s) may be dependent upon the outcome of the primary and/or secondary games activated on the selected gaming machine(s).

According to still another embodiment, the present invention is a gaming system that may include a communication network; a first and a second gaming machine coupled to the communication network, each of the first and second gaming machines including a first and a second display and each being configured to enable a same or different primary game to be displayed on its respective first display; at least one secondary game that may be selectively activated on the second display of the first gaming machine for a limited period of time and, near or at the end of the limited period of time, the at least one secondary game including a player-perceptible indication that is configured to appear to jump or to move from the second display of the first gaming machine to the second display of the second gaming machine.

The player-perceptible indication(s) may be selectively activated without interrupting game play of the primary game.

BRIEF DESCRIPTION OF THE DRAWINGS

FIG. 5 shows an example of a paytable that may be utilized in conjunction with embodiments of the present invention.

DETAILED DESCRIPTION OF THE INVENTION

In the following detailed description of exemplary embodiments of the invention, reference is made to the accompanying drawings, which form a part hereof, and in which is shown by way of illustration specific exemplary embodiments in which the invention may be practiced. These embodiments are described in sufficient detail to enable those skilled in the art to practice the invention, and it is to be understood that other embodiments may be utilized and that logical, mechanical, electrical and other changes may be made without departing from the spirit or scope of the present invention. The following detailed description is, therefore, not to be taken in a limiting sense, and the scope of the present invention is defined only by the appended claims.

Figure 1:
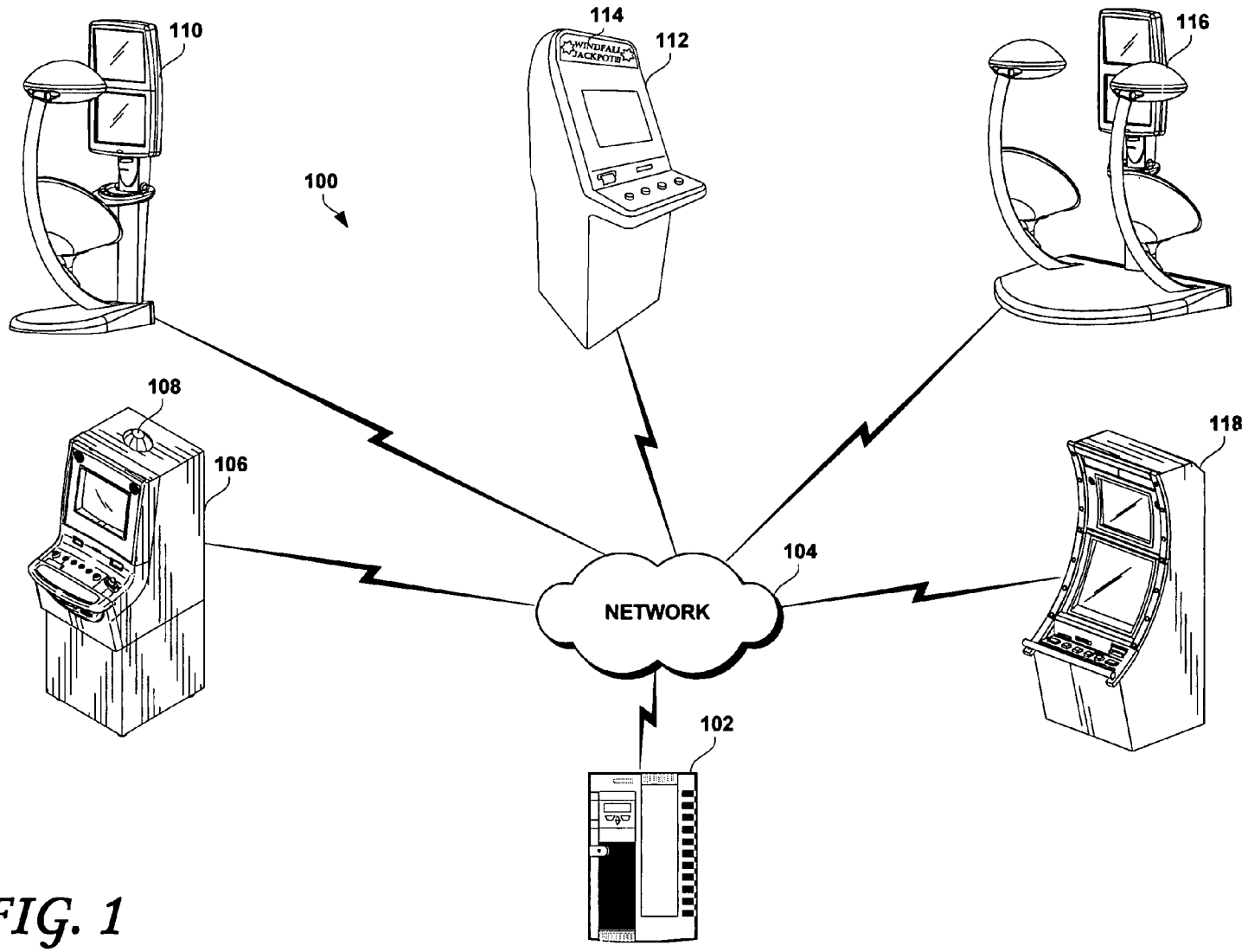
FIG. 1 illustrates a gaming system with which embodiments of the present invention may be practiced.

FIG. 1 illustrates a gaming system 100 with which embodiments of the present invention may be practiced. The system 100 may include a plurality of gaming machines such as shown at 106, 110, 112, 116 and 118. These gaming machines are only representative of the types of gaming machines with which embodiments of the present invention may be practiced. In practice, there may be hundreds or thousands of gaming machines (such as shown or altogether different) that are networked together in a casino. Each or selected ones of these gaming machines may be coupled to one another and/or to a central server 102 over one or more networks 104. The system 100 may also include a cashier terminal or an automatic cashier (not shown) and/or other devices. The network 104 may be wired and/or wireless and may include such security measures as are desirable or required by local gaming regulations. Moreover, the gaming machines 106, 110, 112, 116 and 118 may be of the traditional cash-in type that includes coins and/or notes acceptors and coins and/or notes dispensers. Alternatively, one or more of the gaming machines 106, 110, 112, 116 and 118 may be of the cashless type such as disclosed, for example, in commonly assigned U.S. Pat. No. 6,916,244 entitled Server-Less Cashless Gaming Systems And Methods, the disclosure of which is incorporated herein. The gaming machines 106, 110, 112, 116 and 118 may be co-located (such as on a casino floor) or widely separated across or within geographical, enterprise, regulatory or functional boundaries.

According to an embodiment thereof, a network of gaming machines may be configured to make one or more games available to the user. For example, each gaming machine may be dedicated to a single game of chance or may be configured to enable the user to select one of a plurality of available games to play on the gaming terminal. Such games may be stored locally on each gaming machine and/or may be downloadable from one or more central server 118 upon request, as disclosed in co-pending and commonly assigned U.S. patent application Ser. No. 10/789,975 filed on Feb. 27, 2004 and entitled Dynamic Configuration Of A Gaming System, the disclosure of which is incorporated herein in its entirety.

According to an embodiment of the present invention, in addition to the primary game or games normally available on each gaming machine, one or more of the gaming machines may be configured to activate one or more additional or secondary games for a predetermined or at least limited period of time. The secondary game may be available on only one gaming machine of the system 100 or may be simultaneously available on more than one of the gaming machines 106, 110, 112, 116 and 118. Similarly, different secondary games may selectively be made active on different gaming machines. Indeed, different secondary games, different jackpot schemes may be activated and animated at any moment on any number of gaming machines within a casino (which may house in excess of 3,000 gaming machines). In any event, the secondary game may be configured to be available and/or active for only a limited and/or predetermined period of time (two minutes, for example) on each gaming machine. Alternatively, the duration of the activation of the secondary game may depend upon an outcome thereof, with a winning player being granted more time, for example. According to an embodiment of the present invention, the secondary game may be made available or active (e.g., available for game play) on a selected one or ones of the gaming machines in a predetermined or random order.

For example, the central server 102 may select which of the gaming machines on which the secondary game is to be active and available to the player. Alternatively in a server-less topology (i.e. peer-to-peer), a pre-selected or random gaming machine may select which of the gaming machines on which the secondary game is to be active and available to the player. The secondary game may be active on the selected gaming machine(s) for the predetermined period of time, whereupon the central server 102 (or a pre-selected or random gaming machine in a server-less peer-to-peer topology) may select another one or ones of the gaming machines 106, 110, 112, 116 and 118 on which to cause the secondary game to become active and available to the player. The central server 102 (or a pre-selected or random gaming machine in a server-less peer-to-peer topology) may cycle through the gaming machines 106, 110, 112, 116 and 118 in this manner in an ordered or random fashion. Alternatively, in a server-less network of gaming machines, the gaming machine(s) on which the secondary game is currently active may select the next gaming machine(s) on which the secondary game is next to become active. It is understood that those of skill in this art will devise other means of causing the secondary game to appear to "move" or "jump" from one gaming machine to another gaming machine, and such other means are deemed to fall within the scope of the present inventions.

The secondary game may be a game in which the user wagers a selected amount independently of the primary game normally played on the gaming machine or may be tied to the outcome of the primary game currently being played. For example, the secondary game may cause, according to preset odds, any payout by the machine to be multiplied by a predetermined coefficient. For example, the secondary game may depend upon the primary game, such that the secondary game may only be activated and played if the player is already playing the gaming machine's primary game or games. According to another embodiment, the secondary game may depend upon the primary game, such that the secondary game may only be activated and played if the player reaches a predetermined win level on the primary game.

Alternatively, the secondary game may operate independently of the primary game currently being played on the gaming machine. Indeed, the secondary game may be activated and played by the player upon demand or when the gaming machine senses an outside event, such as a player approaching the gaming machine. For example, the secondary game may simply be added to menu list of available games on the selected gaming machine on which the secondary game is activated. According to another embodiment, the secondary game may be randomly selected amongst a plurality of available secondary games. According to this embodiment, not only may the gaming machine on which the secondary game is to be activated be randomly selected, but the secondary game itself may be randomly selected from amongst a plurality of available secondary games.

The secondary game may invite the player to place a wager during the time in which the secondary game is active on the player's gaming machine. Alternatively still, the secondary game may operate without any wager on the player's part and may inform the user whether he or she has won, independently of any player action. According to one embodiment of the present invention, if the secondary game is simultaneously active one more than one gaming machine, any payout may be (but need not be) divided among the gaming machines on which it is simultaneously active. For example, if the secondary game is simultaneously active on two gaming machines and a jackpot is won, the payout may be split in two, each player receiving half of the payout. Alternatively, the payout of the secondary game may be determined according to a progressive jackpot scheme. The payout paid to a winning player by the secondary game may also take many forms. For example, a randomly selected special bonus paytable (an example of which is shown at 502 in FIG. 5) may be selected from amongst a plurality of such special bonus paytables. In this manner, the randomly selected special bonus paytable may define the winnings paid to a winning player of the secondary game. The secondary game may or may not require player interaction; in the second case then a bonus value is simply given to the player, or an animation such as keno draw or lottery dray may be shown prior to awarding the bonus amount. Alternatively when the secondary game may not require player interaction, a random draw may be performed and the associated animation may be displayed. From the discussion above, it will be apparent to those of skill in this art that a great number of permutations of selected gaming machine(s), secondary game(s), paytable(s) and other characteristics and parameters are possible. All such permutations, therefore, are deemed to fall within the scope of the present inventions.

For example, one or more tertiary game(s) may be selectively activated based upon some predefined or random criteria. For example, various relationships between the primary, secondary and tertiary games may be defined, implemented and enforced. Moreover, the gaming machines implementing aspects of the claimed embodiments need not be co-located. For example, the gaming machines on which embodiments of the present invention are implemented need not reside in a single casino. Indeed, such gaming machines may be widely distributed across a wide geographical area. The gaming machines may be within the same casino, across casinos, on one or more cruise ships. For example, the plurality of gaming machines may reside within a national chain of convenience stores, for example. In the latter case, a first gaming machine located within a first franchisee's convenience store in New Jersey may be selected to randomly activate one or more of the secondary games. Thereafter, a second gaming machine located within a second franchisee's convenience store in Nevada may thereafter be selected to randomly activate the same or another secondary game.

According to further embodiments of the present invention, some animation, flashing light, music, vibration or sound may be generated on the gaming machine on which the secondary game is active and/or will be active. This alerts players and potential players that the gaming machine on which such flashing light (a holograph, for example), music or sound occurs is susceptible to winning the secondary game. This entices potential players to approach the gaming machine and to play and also provides an incentive for the gaming machine's player to keep playing, at least while the secondary game is active on the player's current gaming machine. For example, a flashing light on top of a gaming machine may attract the attention of all players of gaming machines within the immediate vicinity, and may cause a player to switch gaming machines to play one of the gaming machine on which the light is flashing, so as to become eligible to win the secondary game. An example of such a gaming machine is shown in FIG. 1 at reference 106, which gaming machine is equipped with flashing light 108.

Figure 2:
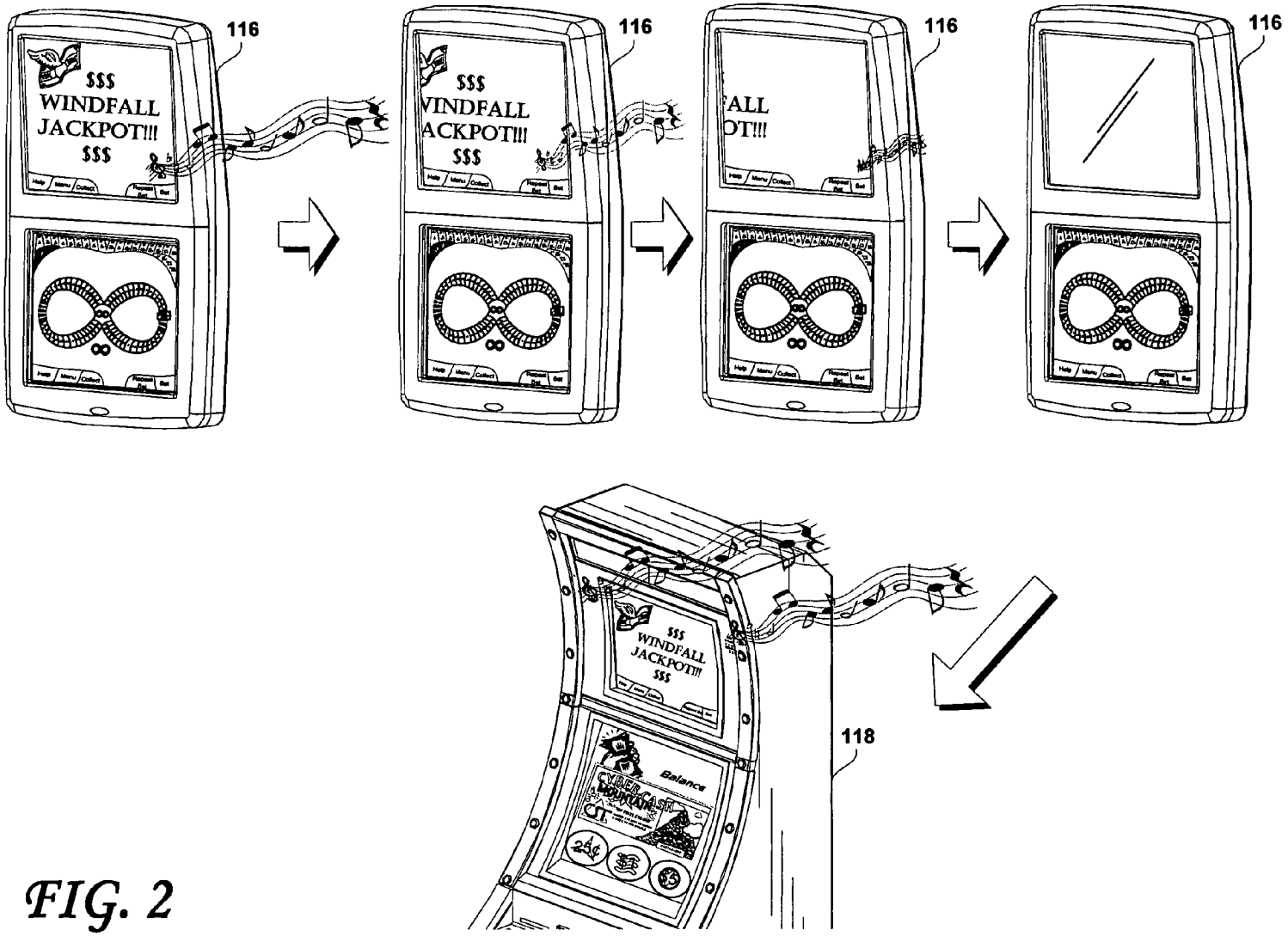
FIG. 2 shows aspects of embodiments of the methods and systems according to the present invention.

Some of the gaming machines 106, 110, 112, 116 and 118 may include two or more displays. Examples of such gaming machines are shown in FIG. 1 at reference numerals 110, 116 and 118. Advantageously, and as shown in FIG. 2, the activation of the secondary game (called Windfall Jackpot in FIG. 2) on such gaming machines may manifest itself by a characteristic display on one (or both) of the displays. In the exemplary embodiment shown in FIG. 2, the secondary game is shown for a predetermined period of time on the top display. As suggested in FIG. 2, when the secondary game is activated on a particular gaming machine, music, an animation, a video or a recognizable sound or jingle may be generated to alert the player or potential player that the secondary game is active or will become active on that gaming machine in the immediate future.

According to an embodiment of the present invention, the secondary game may be only active on any one of the gaming machines 106, 110, 112, 116 and 118 for a limited and/or predetermined period of time. Various animations may be used to alert the user of the time left during which the secondary game will be active. For example and as shown in FIG. 2, the secondary game display may appear to run off the display's screen. That is, the secondary game display may start off fully centered in the gaming machine's display, and appear to shift to one side or the other to eventually disappear entirely from the gaming machine's display after the predetermined period of time during which the secondary game is to be active has elapsed. Other means may be used to alert the user of the time remaining, such as a simple counter. Alternatively, the secondary game may "disappear" (become inactive) from the gaming machine's display without warning. Thereafter, the secondary game may appear to "move" from the gaming machine 116 to the gaming machine 118. In this state, the secondary game is no longer active or available to the player of gaming machine 116, but is newly activated and available to the player (if any) of the gaming machine 118, whether such gaming machine has been randomly selected or is next in line to activate the secondary game. Music and/or a jingle or other player-perceptible indication may reinforce the effect, including music that decreases in volume as the secondary game moves to another gaming machine. In this manner, The secondary game appears to the players on the casino floor as a roving and unpredictable opportunity to win additional prizes or bonus, or to be able to enter large outcome games, with animations, sounds and/or other enticing effects running from one gaming machine to another. Players may attempt to "follow" the player-perceptible indication and/or secondary game as it "moves" or "jumps" from one gaming machine to another, thereby further animating the casino floor. The player-perceptible may appear to move from gaming machine to gaming machine and may precede the appearance of the secondary game, to heighten the players' anticipation.

When the secondary game disappears from the gaming machine's second display, the display may return to its previous function, if any. For example, the second display may show details concerning the user's current balance, a menu of other available games or any other graphic or animation designed to entice or entertain the player.

Selection of the gaming machine in which the secondary game is activated need not be entirely (or at all) random. Indeed, selection of the gaming machine on which one or more of the secondary games is/are to be activated may be based upon some measurable threshold, characteristic or variable. For example, the selection of a current and/or next gaming machine may be made for financial reasons, to optimize traffic in a predetermined area of the casino floor or other reasons. For example, selection of the gaming machine(s) on which the secondary game(s) is/are to be activated may be made based upon which of a plurality of gaming machines has the lowest drop, or that or those gaming machines with the lowest or a predetermined low number of bets. Other alternatives are possible and may occur to those of skill in this art. Likewise, the paytable(s) defining the winnings of a winning secondary game player may be transferred from one gaming machine to one or more other gaming machines, either randomly or in a directed manner. For example, the secondary game may be tied to a primary game of video poker. If, for example, the player draws a Full House while the secondary game is activated on his or her gaming machine, the secondary game paytable transferred to that gaming machine may dictate that the player be paid double the usual winnings for such a hand. The secondary game may, therefore, be called "Full House Frenzy", and may double the player's winnings during the time that the secondary game is active on the player's selected gaming machine. Many other variations may be devised by those of skill and all such variations are deemed to fall within the scope of the present invention. For example, the secondary game(s) may be activated when one or more persons approach the gaming machine, using a proximity sensor, for example.

Figure 3:
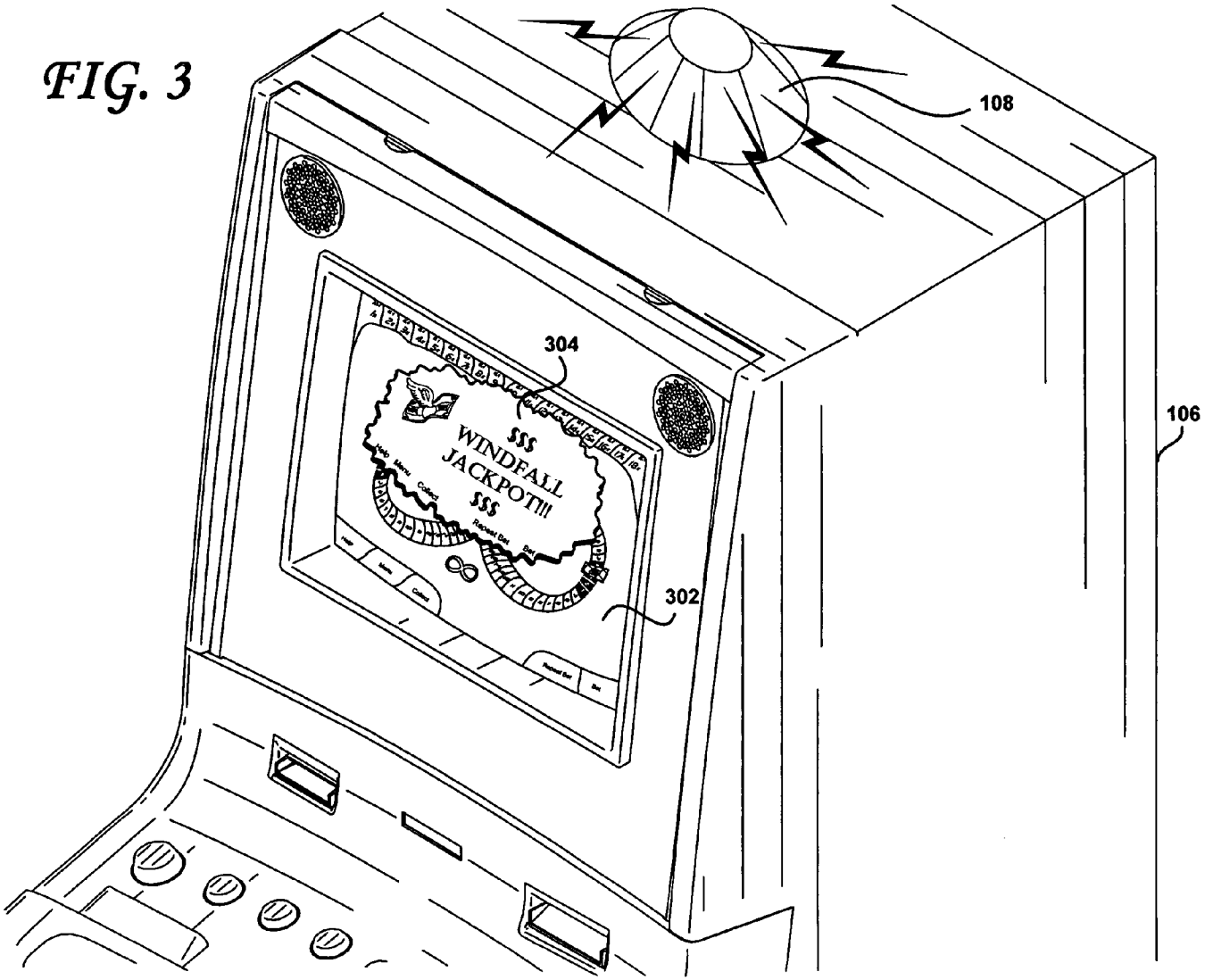
FIG. 3 shows a portion of a single-display gaming machine with which embodiments of the present invention may be practiced.

FIG. 3 is a detail view of the gaming machine 106. Gaming machine 106 is a gaming machine that includes only a single display. The display may show the primary game 302 currently played by the player on the gaming machine 106. When this gaming machine is selected (by the central server 102, for example) as the next gaming machine on which the secondary game is to be activated, a flashing (for example) light 108 or other visual or sound device may be activated to alert the current player of gaming machine 106 or potential players in the immediate vicinity that the secondary game is or is about to become activated on the gaming machine 106. For gaming machines without a second display such as gaming machine 106, a pop-up window 304, picture-in-picture or picture-by-picture announcing the activation of the secondary game may be generated and rendered on the single display. Provisions may be made to enable the player to dismiss the pop-up window 304 is he or she does not wish to play the secondary game. Alternatively or in addition to such provisions, the pop-up window 304, the picture-in-picture or the picture-by-picture may be rendered with a selectable degree of transparency to enable continued game play of the underlying and primary game 302. The degree of transparency or "alpha-blending" may be increased until the secondary game effectively disappears from the gaming machine's display and becomes de-activated on that gaming machine.

Figure 4:
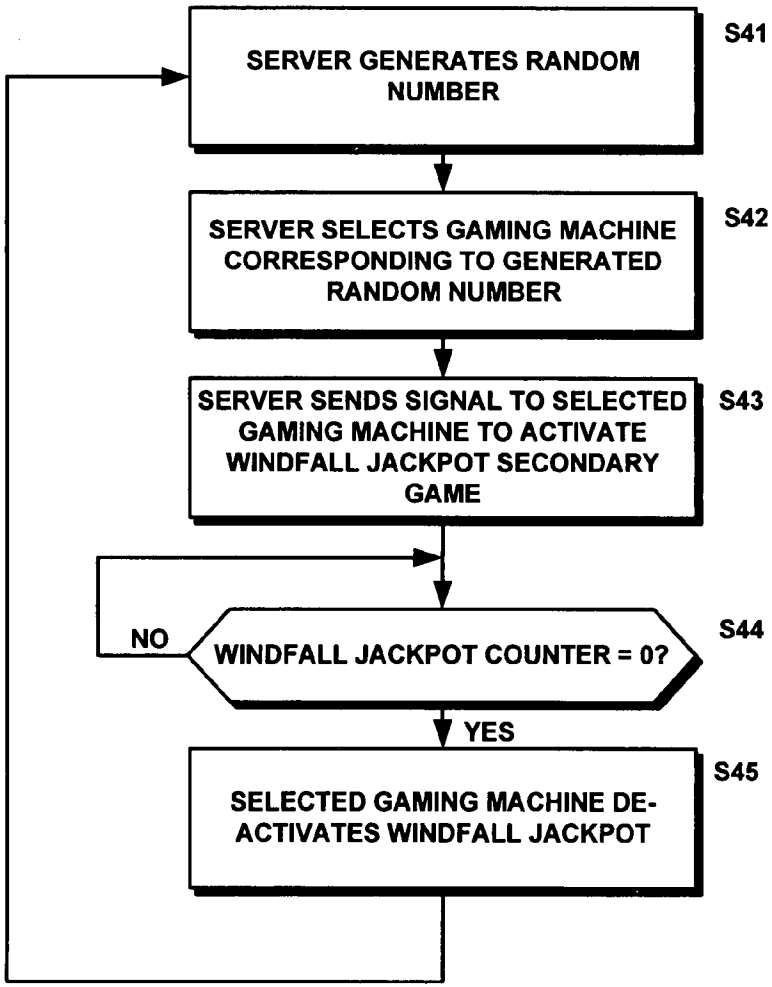
FIG. 4 is a flowchart of an embodiment of the present invention.

FIG. 4 is a flowchart of an embodiment of the present invention. As shown, step S41 calls for the central server 102 (or a pre-selected or random gaming machine in a server-less peer-to-peer topology) to generate a random number and to select a gaming machine from among a plurality of such gaming machines that corresponds to the generated random number, as called for by step S42. It is understood that the gaming machines may be sequentially selected by other means than the generation of random numbers. For example, the gaming machines on which the secondary game is to be activated may be selected from a predetermined list or by other means. As suggested by step S43, the central server 102 (or a pre-selected or random gaming machine in a server-less peer-to-peer topology) may then send a signal to the selected gaming machine over the network 104. This signal tells the selected gaming machine to cause the secondary game to be activated and to take any other ancillary measures that may be necessary, such as causing music to be played, a light to flash or an animation to be rendered on the selected gaming machine's display(s). According to an embodiment of the present invention, the secondary game may be activated only for a selectable period of time of the selected gaming machine. For example, a counter may be started and decremented (for example) until it reaches a zero value, as suggested by step S44. Such a counter may reside on the central server 102 or may reside on the selected gaming machine. In this embodiment, the secondary game remains active until the counter reaches zero (or a predetermined number corresponding to a predetermined period of time). When the predetermined period of time has elapsed, the selected gaming machine de-activates the secondary game or the secondary game is de-activated by the central server 102 (or a pre-selected or random gaming machine in a server-less peer-to-peer topology). When the secondary game is de-activated on a gaming machine, the player on that gaming machine can no longer win the secondary game, as the secondary game must be activated for a player to win. The method may then revert to step S41, whereupon the central server (or a pre-selected or random gaming machine in a server-less peer-to-peer topology) may select another gaming machine on which to activate (or cause to be activated) the secondary game.

Advantageously, according to embodiments of the present invention, the secondary game or secondary game appears as a roving and unpredictable game of chance to the players on the casino floor, with animations, sounds and/or other enticing effects running from one gaming machine to another. It is anticipated that players may attempt to "follow" the secondary game as it "moves" or "jumps" from one gaming machine to another, thereby further animating the casino floor.

What is claimed is:

1. A method of operating a plurality of networked gaming machines, each of the plurality of networked gaming machines being configured to enable a same or a different primary game to be played, the method comprising the steps of:

activating and enabling wagers to be placed on a secondary game on a selected first gaming machine of the plurality of networked gaming machines;

displaying the activated secondary game on a display of the first gaming machine;

gradually shifting the displayed secondary game out of view on the display of the first gaming machine toward a selected second gaming machine of the plurality of networked gaming machines and gradually shifting the secondary game into view on a display of the second gaming machine;

activating and enabling wagers to be placed on the secondary game on the second gaming machine as soon as the secondary game begins to shift into view on the display of the second gaming machine, and deactivating and disallowing wagers from being placed on the secondary game on the first gaming machine when the secondary game has fully shifted out of view on the display of the first gaming machine.

2. The method of claim 1, wherein game play of the primary game is not interrupted on the first gaming machine while the secondary game is activated on the first gaming machine.

3. The method of claim 1, wherein the secondary game is activated on the second gaming machine while the second gaming machine is unattended.

4. The method of claim 1, wherein the secondary game is configured to operate free of player interactivity and wherein the method further comprises showing an animation prior to awarding a predetermined bonus value or a randomly drawn price.

5. The method of claim 1, wherein the secondary game is activated when a player is carded-in.

6. The method of claim 1, wherein the secondary game is activated when a player is not currently playing but has some credits.

7. The method of claim 1, wherein the limited time period is a predetermined period of time controlled by a counter.

8. The method of claim 7, wherein the plurality of networked gaming machines is coupled to a central server, and wherein the counter resides on the central server.

9. The method of claim 1, wherein the plurality of networked gaming machines is coupled to a central server, and wherein at least one of the activating and de-activating steps are controlled or triggered by the central server.

10. The method of claim 1, wherein at least one of the activating and de-activating steps are controlled or triggered by one of the first and second gaming machines.

11. The method of claim 1, wherein the first and second gaming machines each includes a first and a second display, and wherein the primary game is displayed on at least the first display and wherein the secondary game is displayed on the second display.

12. The method of claim 1, wherein at least one of the first and second gaming machines includes a single display, and wherein the primary game is displayed on the single display and wherein the secondary game is displayed on at least a portion of the single display without interrupting game play of the primary game.

13. The method of claim 12, wherein the secondary game is displayed as one of a pop-up window, a picture-in-picture and a picture-by-picture within the single display.

14. The method of claim 1, wherein the selecting step randomly selects the first gaming machine from the plurality of networked gaming machines.

15. The method of claim 1, wherein at least one of the activating, generating and the deactivating steps is controlled or triggered in a serverless fashion by at least one predetermined or randomly selected gaming machine of the plurality of networked gaming machines.

16. The method of claim 1, wherein at least one of the activating, generating and deactivating steps is controlled or triggered in a peer-to-peer fashion by at least one predetermined or randomly selected gaming machine of the plurality of networked gaming machines.

17. The method of claim 1, further including steps of playing an animation before at least one of the activating and de-activating steps.

18. The method of claim 1, wherein an outcome of the secondary game depends upon an outcome of the primary game.

19. The method of claim 1, wherein an outcome of the secondary game is independent of an outcome of the primary game.

20. The method of claim 1, wherein the selecting step is configured to select the first gaming machine only if the first gaming machine is currently being played.

21. The method of claim 1, further comprising a step of selecting a paytable from a plurality of paytables, the selected paytable determining a payout of the secondary game.

22. The method of claim 21, wherein the paytable selecting step randomly selects the paytable from the plurality of paytables.

23. The method of claim 1, further comprising at least one tertiary game, and wherein the method further includes steps of selectably activating the at least one tertiary game during or after activation of the secondary game.

24. The method of claim 23, wherein activation of the tertiary game is dependent upon an outcome of at least one of the primary and secondary games.

25. The method of claim 7, wherein the counter is visible to a player.

26. The method of claim 7, wherein the counter is not visible to a player.

27. A gaming system, comprising:

a communication network;

a plurality of gaming machines coupled to the communication network, each of the plurality of gaming machines being configured to enable a same or different primary game to be played;

a secondary game that is selectively activated on a selected one of the plurality of gaming machines, wherein the activated secondary game is configured to gradually shift into view on the selected gaming machine and activate for a predetermined period of time and thereafter to gradually shift out of view on the selected gaming machine and to gradually shift into view and activate on a selected other one of the plurality of gaming machines and wherein when the secondary game is simultaneously active on both the selected gaming machine and on the selected other one of the plurality of gaming machines, any payout on wagers placed on the secondary game are divided among players of the selected gaming machine and of the selected other one of the plurality of gamine machines.

28. The gaming system of claim 27, wherein the secondary game is configured to be de-activated at the end of the limited period of time.

29. The gaming system of claim 27, further comprising a counter that controls a length of the limited period of time.

30. The gaming system of claim 29, wherein the counter is visible to players of the selected gaming machines.

31. The gaming system of claim 29, wherein the counter is not visible to players of the selected gaming machines.

32. The gaming system of claim 27, wherein the selected one of the plurality of gaming machines is configured to select the other one of the plurality of gaming machines on which the secondary game is to be activated.

33. The gaming system of claim 27, further comprising a central server coupled to the communication network and wherein the central server is configured to select on which the secondary game is to be activated.

34. The gaming system of claim 27, wherein the system is configured such that a selection of the other one of the plurality of gaming machines is performed in a serverless fashion.

35. The gaming system of claim 27, wherein the system is configured such that a selection of the other one of the plurality of gaming machines is performed in a peer-to-peer fashion.

36. The gaming system of claim 33, further comprising a serverless scheme configured to select the other one of the plurality of gaming machines on which the secondary game is to be activated.

37. The gaming system of claim 33, further comprising a peer-to-peer scheme configured to select the other one of the plurality of gaming machines on which the secondary game is to be activated.

38. The gaming system of claim 29, further comprising a central server coupled to the communication network and wherein the counter resides on the central server.

39. The gaming system of claim 27, wherein the gaming machines each include a first and a second display, and wherein the first display is configured to display the primary game and wherein the second display is configured to display the secondary game.

40. The gaming system of claim 27, wherein the gaming machines include a single display, and wherein the gaming machines are configured to display the primary game on the single display and to display the secondary game on at least a portion of the single display.

41. The gaming system of claim 40, wherein the gaming machines are configured to display the secondary game as one of a pop-up window, a picture-in-picture or a picture-by-picture within the single display.

42. The gaming system of claim 27, wherein the at least some of the gaming machines include means for generating at least one of a light, an animation, a video, a vibration and a sound immediately before or during activation of the secondary game.

43. The gaming system of claim 27, wherein the gaming machines are further configured to play an animation before the secondary game is at least one of activated and de-activated.

44. The gaming system of claim 27, wherein an outcome of the secondary game depends upon an outcome of the primary game.

45. The gaming system of claim 27, wherein an outcome of the secondary game is independent of an outcome of the primary game.

46. The gaming system of claim 27, wherein the secondary game is configured to be activated only if the primary game is currently being played.

47. The gaming system of claim 27, wherein the secondary game is configured to selectively pay winnings according to a selected one of a plurality of paytables.

48. The gaming system of claim 27, wherein the system further comprises at least one tertiary game configured to be selectively activated on the gaming machines.

49. The gaming system of claim 48, wherein activation of the at least one tertiary game is dependent upon an outcome of at least one of the primary and secondary games.

50. A gaming system, comprising:

a communication network;

a first and a second gaming machine coupled to the communication network, each of the first and second gaming machines including a first and a second display and each being configured to enable a same or different primary game to be displayed on its respective first display;

at least one secondary game that is selectively activated on the second display of the first gaming machine wherein the at least one secondary game is configured to appear to gradually move from the second display of the first gaming machine to the second display of the second gaming machine, wherein the at least one secondary game is also activated on the second gaming machine as soon as the at least secondary game begins to be displayed on the second display of the second gaming machine, and wherein when the secondary game is simultaneously active on the first and second gaming machines, any payout on wagers placed on the secondary game are divided among players of the first and second gaming machines.

51. The method of claim 1, wherein when the secondary game is simultaneously active on the first and second gaming machines, any payout on wagers placed on the secondary game are divided between players of the first and second gaming machines.

* * * * *